US006560935B1

(12) United States Patent
Barefield et al.

(10) Patent No.: US 6,560,935 B1
(45) Date of Patent: May 13, 2003

(54) POST ANCHOR

(76) Inventors: David H Barefield, deceased, late of Avon Park, FL (US); by Janice F. Barefield, legal representative, 1605 Palm Dr., Avon Park, FL (US) 33825

( * ) Notice: Subject to any disclaimer, the term of this patent is extended or adjusted under 35 U.S.C. 154(b) by 138 days.

(21) Appl. No.: 09/712,828

(22) Filed: Nov. 14, 2000

Related U.S. Application Data

(63) Continuation-in-part of application No. 09/304,811, filed on May 4, 1999, now abandoned, which is a continuation-in-part of application No. 08/916,068, filed on Aug. 21, 1997, now Pat. No. 5,899,030, which is a continuation-in-part of application No. 08/631,971, filed on Apr. 15, 1996, now Pat. No. 5,661,932.

(51) Int. Cl.[7] ..... E04H 12/20; E04H 17/22

(52) U.S. Cl. ..... 52/154; 52/159; 52/166; 403/371; 403/374

(58) Field of Search ..... 52/154, 155, 158, 52/159, 166, 298; 403/374, 371; 248/545, 156, 530

(56) References Cited

U.S. PATENT DOCUMENTS 3,727,357 A * 4/1973 Stillman, Jr. ..... 52/154
4,252,472 A * 2/1981 Moraly ..... 405/244
4,702,639 A * 10/1987 Hinterholzer ..... 404/10
5,661,932 A * 9/1997 Barefield ..... 52/154
5,899,030 A * 5/1999 Barefield ..... 52/154

* cited by examiner

*Primary Examiner*—Yvonne M. Horton

(57) ABSTRACT

A driveable member and a locking member cooperate to form a post anchor which is utilized in earthen ground to support a post. The driveable member is capable of being driven into the earthen ground during an installation process wherein a post extends from the driveable member following the installation process. The locking member acts to secure the post and the driveable member together using a binding pressure between a post support sleeve of the driveable member and the outer surface of the post. Ideally the locking member is installed during the installation process utilizing an installation impact force which is delivered generally aligned with the length of the post to bind the locking member between the driveable member and the post. A method of coupling the locking member relative to the driveable member prevents any tendency of the locking member to become dislodged subsequent to the installation process.

11 Claims, 7 Drawing Sheets

POST ANCHOR

CROSS-REFERENCES

The present application is a continuation-in-part application of U. S. application Ser. No. 09/304,811, now abandoned filed May 4, 1999, entitled "Post Anchor with Anchor Clip", currently pending, which is a continuation-in-part of U. S. Pat. No. 5,899,030, application Ser. No. 08/916,068, filed Aug. 21, 1997, entitled "Sheet Material Post Anchor and Method of Installation", which is a continuation-in-part of U. S. Pat. No. 5,661,932, application Ser. No. 08/631,971, filed Apr. 15, 1996, entitled "Post Anchor and Method of Installing a Post". These applications are incorporated herein by this reference.

BACKGROUND

1. Field of the Invention

Generally, the invention relates to post anchors to secure a post in the earthen ground. More specifically, the invention relates to such post anchors which are driveable, adaptable for deployment without requiring the use of concrete and which utilize a locking member which contacts both the post anchor and the post following installation.

2. Description of the Prior Art

The anchoring of posts in the earthen ground satisfies various needs. The attachment of signs to the post, as exampled by signs posted in yard advertising the availability of the property for sale, is one common example. Similarly, the attachment of signs to posts along roads advise motorists of various conditions or that various provisions of laws are in effect for that specific stretch of road. Common examples of these type of signs include 'stop' signs and signs notifying motorists of the 'posted' speed limits in effect.

Turning now to posts which support structural entities rather than signs, the most common structure supporting use of posts is to support fencing. In this usage, a configuration of a plurality of posts cooperate to provide for an aligned arrangement, most often linear. A common usage involves various linear sections which cooperate to define a perimeter which surrounds and encloses an area.

In the agricultural area, posts enclose areas with barbed wire or a heavy gauge wire mesh fencing spanning and attached to each post in succession. This usage provides for the containment or exclusion of animals.

In the residential area, posts enclose areas with chain link, boarding or some other suitable material spanning and attached to each post in succession. This usage commonly defines a section of the boundaries of the subject property, as exampled by enclosing the backyard of a home. This usage is extremely common due to the desire of people to restrict ingress and egress from their property.

The most common method in current use of anchoring a post into the earthen ground comprises the following steps. Digging of a deep narrow hole into the ground occurs. Following forming of this hole, insertion of a lower extent of a post into the hole occurs. Then the placement of concrete to radially surround the lower extent of the post occurs to at least partially fill the hole. Following the setting of this concrete, generally the following day, installation of the fencing material occurs to span a plurality of such installed posts and define the fence.

Several disadvantages exist with this method which make the method less efficient than desired. Sandy soil conditions often tend to expand the upper extent of the hole beyond the desired size. There is a requirement of special motorized digging equipment which eliminates the requirement of manually scooping out the dirt with post hole diggers. The labor expense involved with the digging of the holes, using either method, is significant. The requirement of mixing concrete at the job site is time consuming, expensive and messy. There is a strong likelihood that even a simple job may span multiple days due to the strong desire that the concrete harden about the lower extent of the post prior to attachment of the fencing material to the post.

Various attempts have been made to provide a structural device capable of placement into the earthen ground for attachment thereto of a post. These devices attempt to provide various large surface areas distributed in the ground to cooperate to act to resist motion of the device while in the earthen ground.

Generally, acceptance in the industry of these devices is lacking. They are difficult to install. They lack sufficient resistance properties once installed to acceptably resist motion of the post above the ground. They are prohibitively expensive when compared to the conventional dig and concrete method. These devices also lack the versatility to permit the elevation of the post to be easily adjusted relative to the fixed anchor device following installation.

When a driveable post anchor is employed it may lack sufficient surface areas thereon to provide a desired level of resistance to displacement of the attached post.

For these reasons there remains a need for a simple anchor device which is adaptable for installation into the earthen ground with minimal labor consumption, which provide for acceptable motion resistance within the earthen ground following installation and which also permit repositioning of the elevation of the post relative to the fixed anchor device without requiring repositioning of the anchor device within the ground. The present invention substantially fulfills these needs.

SUMMARY

In view of the foregoing disadvantages inherent in the conventional method of anchoring a post within the earthen ground, your applicant has devised a post anchor having a driveable member and a locking member. The driveable member has a post support sleeve and a plurality of ground engaging fins. The post support sleeve has an inner surface, an outer surface and an upper extent. The post support sleeve provides for reception of a post therein during an installation process. The plurality of ground engaging fins are radially disposed to extend from the outer surface of the post support sleeve. The locking member provides for securing of the post within the post support sleeve following the installation process. The locking member contacts the post support sleeve at the inner surface and contacts the post at an outer surface of the post following the installation process.

The invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The primary object of the present invention is to provide for a post anchor having a locking member and a driveable member where the post anchor will anchor a post in the earthen ground with at least a portion of the locking member positioned between the driveable member and the post.

Other objects include;

a) to provide for installation of a post anchor and a post with a minimal amount of effort.

b) to provide for immediate usage of the post secured to the post anchor following installation without requiring passage of a setting time interval.

c) to provide for impact force generated installation of the locking member relative to and between the driveable member and the post.

d) to provide for the reuse of the driveable member of the post anchor following removal of the locking member and removal of the post.

e) to provide for a locking member which provides for a prolonged application of a binding pressure between a post support sleeve of the driveable member and the post positioned within the post support sleeve of the driveable member following an installation process.

f) to provide for a locking member having an impact portion and a penetration portion where the impact portion provides for reception of an installation impact force and where the penetration portion provides for insertion in response to the installation impact force between an inner surface of the post support sleeve of the driveable member and an outer surface of the post during the installation process.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION

Figure 1:
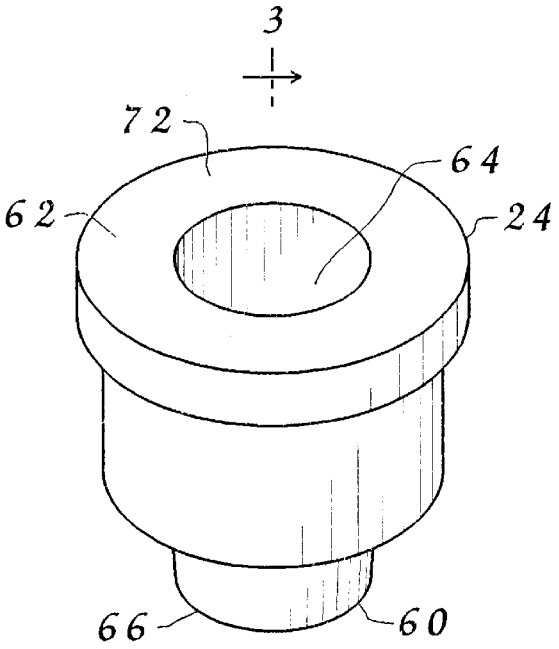
FIG. 1 is a perspective view of a locking member.
Figure 2:
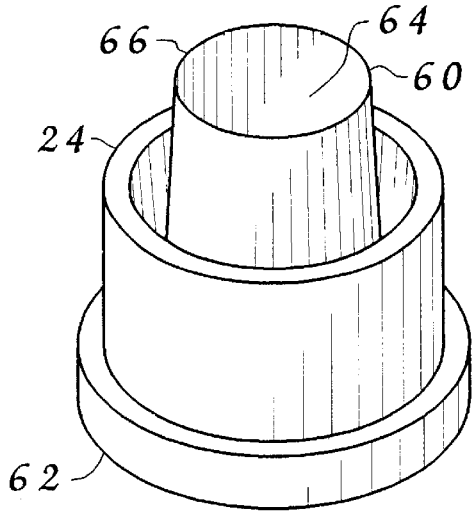
FIG. 2 is another perspective view of the locking member shown in FIG. 1.

Reference is now made to the drawings where like reference numerals refer to like parts throughout the various views. Post anchors having features of the present invention will have a driveable member and a locking member.

Driveable Member

The driveable member will have a post support sleeve and a plurality of ground engaging fins extending from the post support sleeve. The post anchor may be formed utilizing a molding process as exampled as by from a plastic. Alternatively, the post anchor may be formed from a sheet material following a bending or stamping process. The post anchor may employ a sub-grade surface to, in part, provide for additional resistance to movement in the earthen ground following installation.

FIG. 1 through FIG. 9 depict a post anchor 20, or portions thereof, having a driveable member 22 and a locking member 24, see FIG. 1 through FIG. 3 and FIG. 6 through FIG. 9. Driveable member 22 has a post support sleeve 26 having an inner surface 28 and an outer surface 30, see FIG. 4. A plurality of ground engaging fins 32 extend outward from outer surface 30 of post support sleeve 26. Ground engaging fins 32 each have an upper extent 34. Preferably post support sleeve 26 extends significantly above upper extent 34 of ground engaging fins 32.

FIG. 14 through FIG. 18 depict a driveable member 36, or portions thereof, having a post support sleeve 38, a plurality of ground engaging fins 40 and a sub-grade surface 42 positioned above, and anchored to, ground engaging fins 40. Post support sleeve 38 penetrates sub-grade surface 42. In this embodiment post support sleeve 38 has opposing compression slots 44 extending downward from a terminal end 46. Radially positioned about terminal end 46 is a coupling member 48 being a ridge 50.

Figure 12:
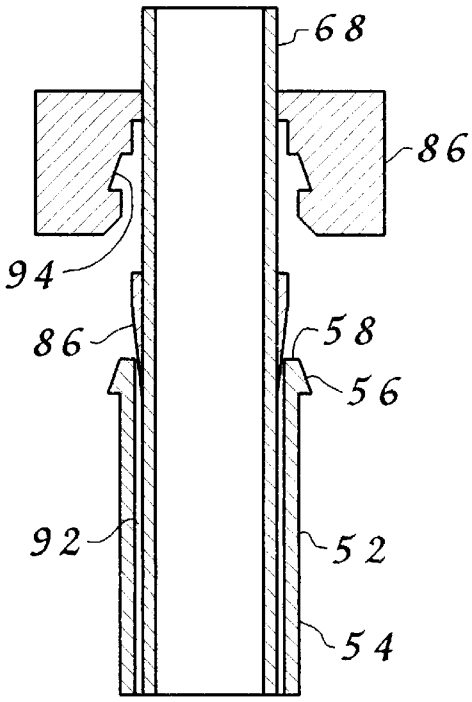
FIG. 12 is an elevational sectional view of the first portion of the locking member shown in FIG. 10 and the second portion of the locking member shown in FIG. 11 positioned relative to a post support sleeve and a post.
Figure 13:
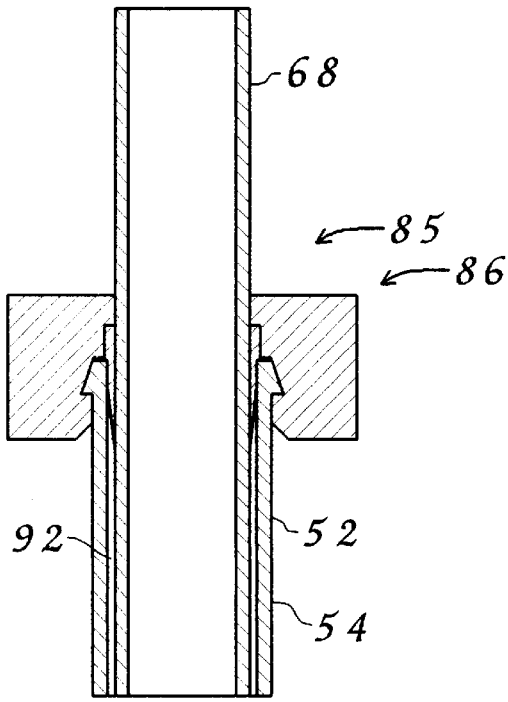
FIG. 13 is an elevational sectional view of the components shown in FIG. 12 following an installation process.
Figure 14:
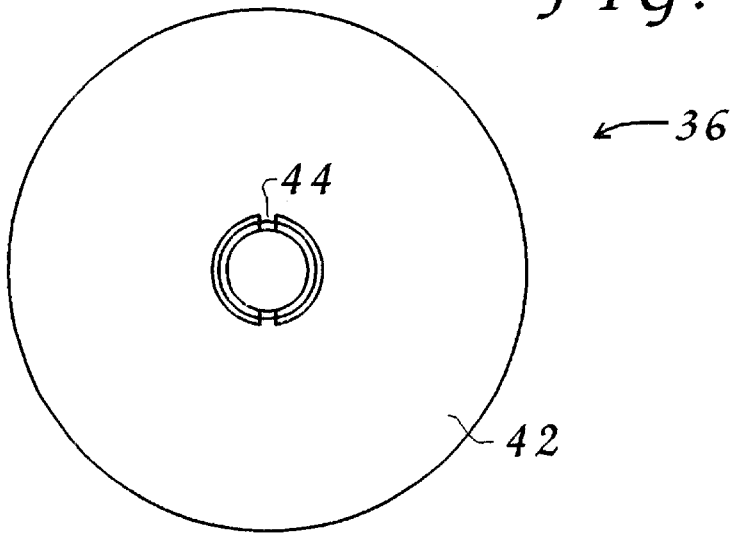
FIG. 14 is a top plan view of a driveable member.
Figure 15:
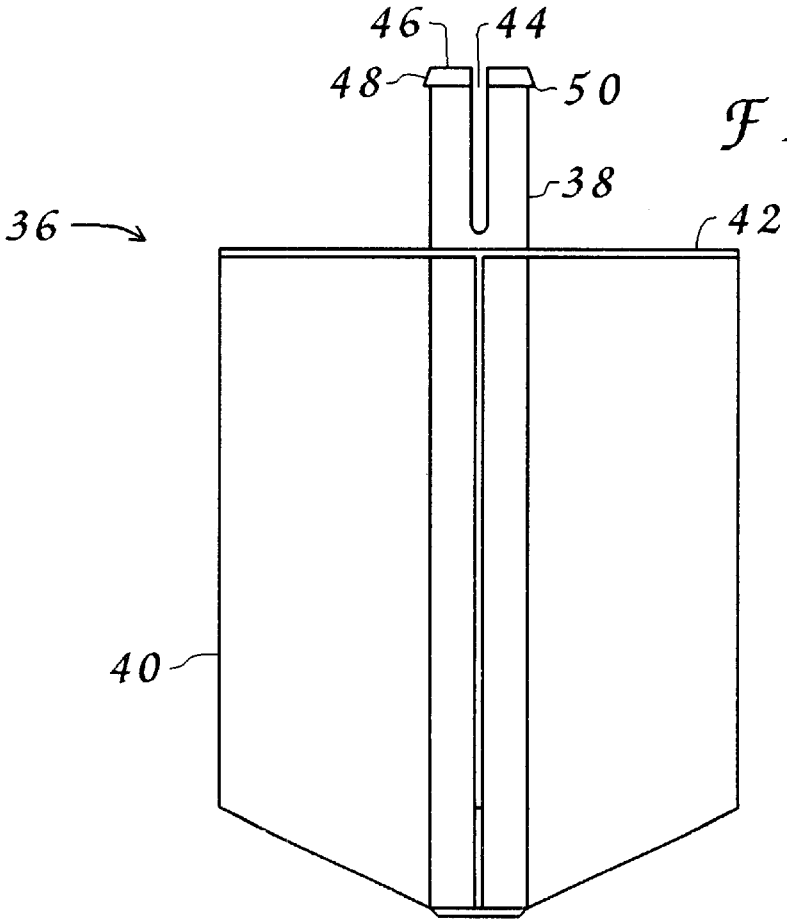
FIG. 15 is an elevational view of the driveable member shown in FIG. 14.
Figure 16:
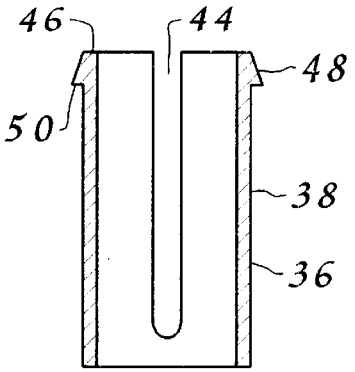
FIG. 16 is an elevational sectional view of a portion of a post support sleeve of the driveable member shown in FIG. 14 and FIG. 15.
Figure 17:
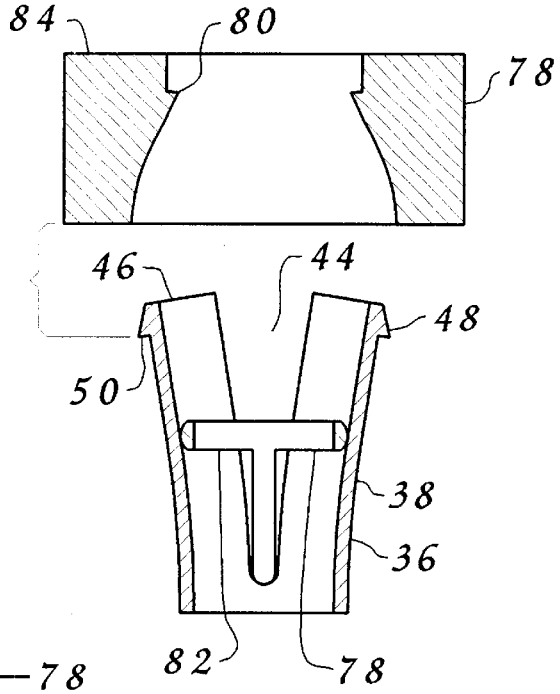
FIG. 17 is an elevational sectional view of the post support sleeve shown in FIG. 16 with a first portion and a second portion of a locking member positioned thereabout.

FIG. 12 and FIG. 13 depict a post support sleeve 52 of a driveable member 54, not shown in its entirety. In this embodiment post support sleeve 52 has a coupling member 56 radially disposed about a terminal end 58. In this embodiment post support sleeve 52 does not have a compression slot.

Locking Member

A locking member provides for a prolonged binding pressure between the driveable member and a post positioned therethrough following the installation procedure. The locking member will engage the driveable member at least at the upper extent of the post support sleeve and at the outer surface of the post following the installation procedure. This arrangement will provide for the desired binding pressure. Ideally, a portion of the locking member will engage the driveable member along a small portion of an inner surface of the post support sleeve in close proximity to the upper extent while an opposing portion of the locking member engages an outer surface of the post.

Typically, pressure binding is all that is required to retain the locking member relative to the driveable member following placement during the installation process. If desired, a method may be provided to couple, or secure, the locking member to the driveable member. When coupling means are provided it may be desired to provide for structures on the driveable member which cooperate with structures on the locking member to provide the desired coupling or securing of the locking member relative to the driveable member.

The locking member may be a single piece or may be formed from a cooperation between multiple pieces. When multiple pieces are utilized they may be unique or they may be identical or they may have two or more identical pieces and at least one additional unique piece.

Figure 3:
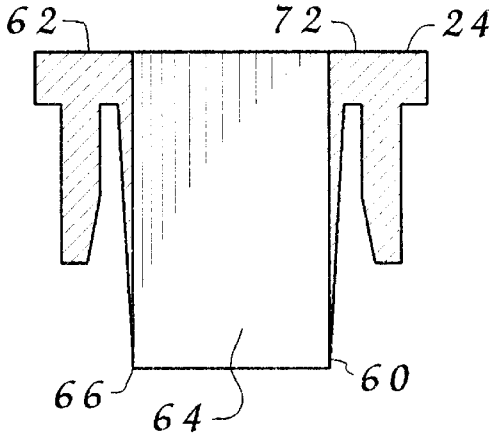
FIG. 3 is a sectional view as taken from the section line '3' shown in FIG. 1.
Figure 4:
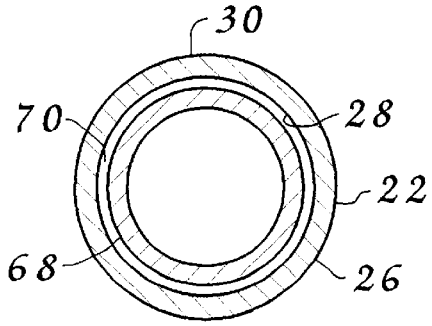
FIG. 4 is a sectional view as taken from the section lines '4' shown in FIG. 6.
Figure 5:
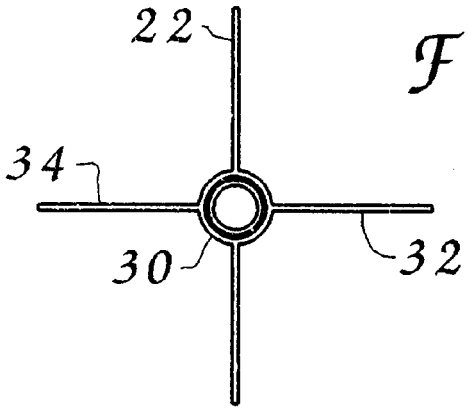
FIG. 5 is a sectional view as taken from the section line '5' shown in FIG. 6.
Figure 6:
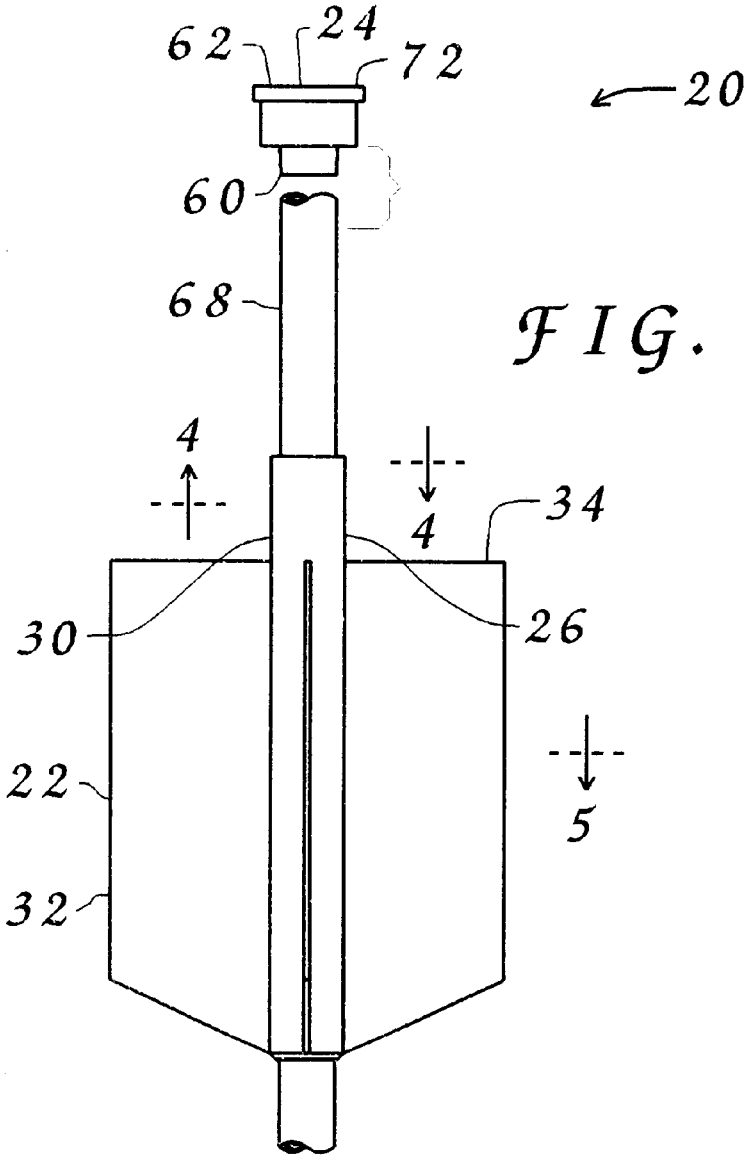
FIG. 6 is an elevational view of a post anchor having a driveable member and a locking member with a post positioned in the driveable member.
Figure 7:
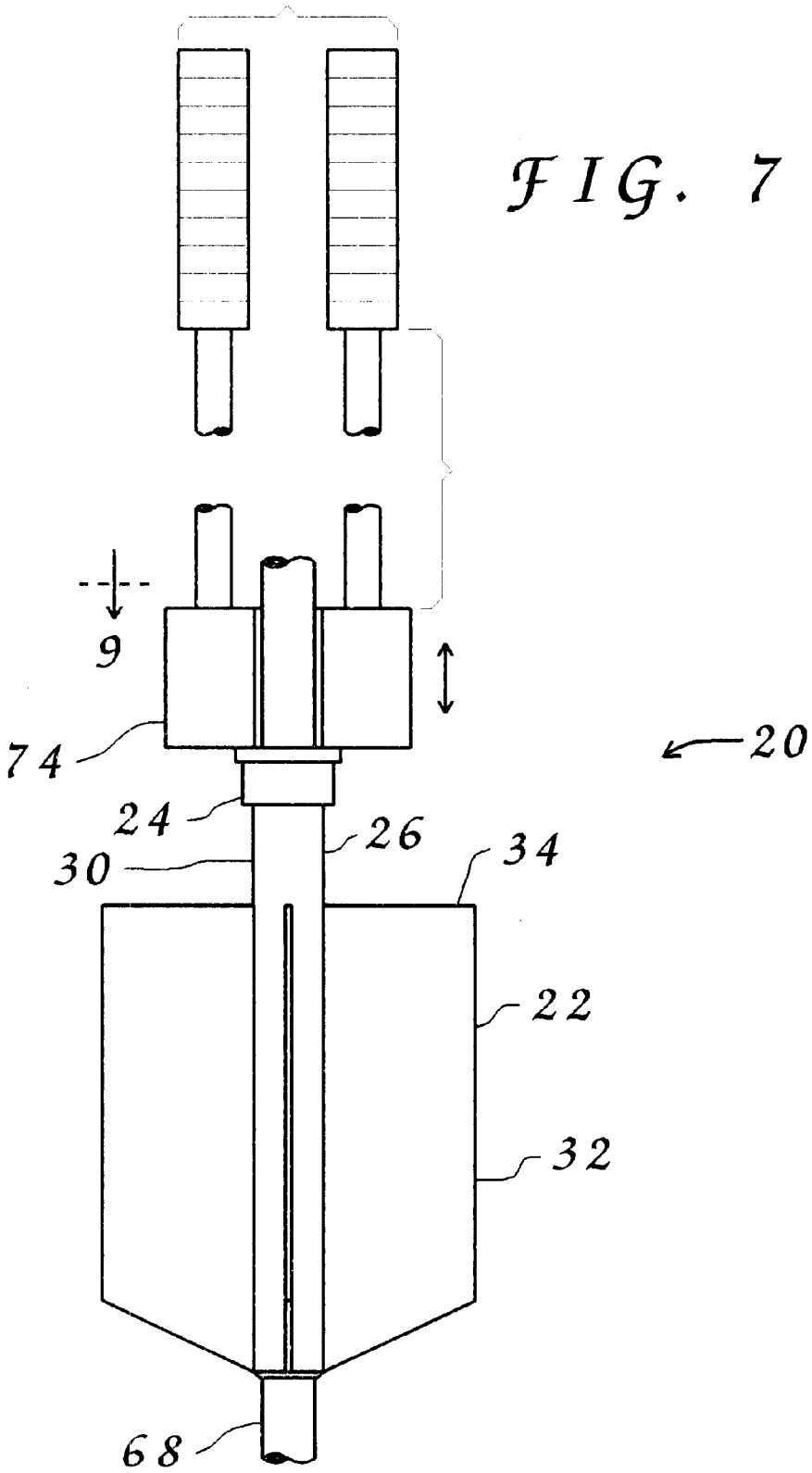
FIG. 7 is an elevational view of the assembly shown in FIG. 6 during an installation process utilizing a locking member seating tool.
Figure 8:
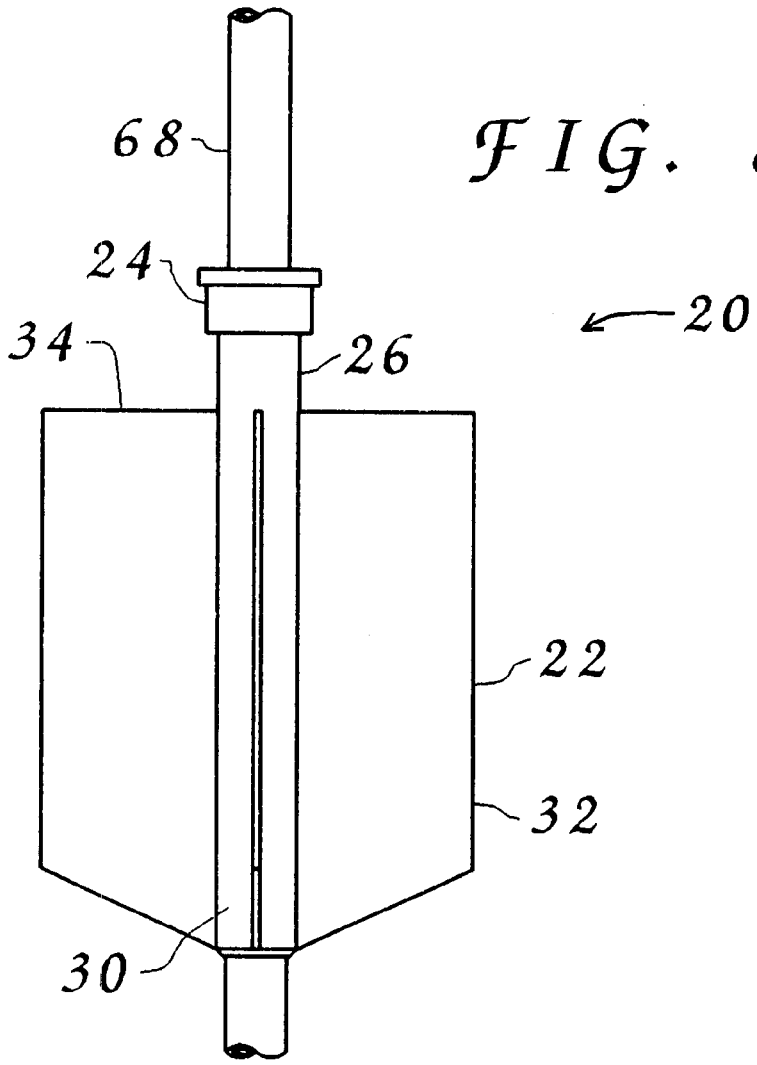
FIG. 8 is an elevational view of the post anchor shown in FIG. 6 and FIG. 7 in an install condition on the post.
Figure 9:
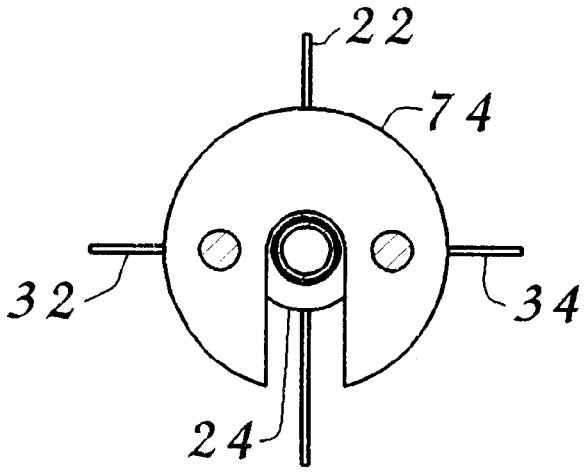
FIG. 9 is a sectional view as taken from the section line '9' shown in FIG. 7.
Figure 10:
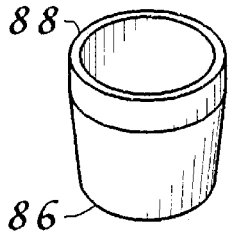
FIG. 10 is a perspective view of a first portion of a locking member.
Figure 11:
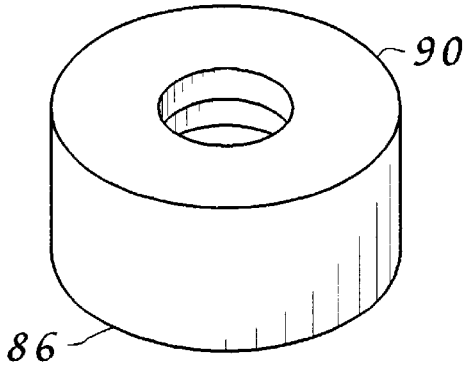
FIG. 11 is a perspective view of a second portion of a locking member.

FIG. 1 through FIG. 3 and FIG. 6 through FIG. 9 depict locking member 24 which is of a single piece. Locking member 24 has a penetration portion 60 and an impact portion 62 with a passage 64 extending therethrough The interior of passage 64 forms a post contacting surface. Penetration portion 60 tapers down to a very narrow terminal edge 66. During an installation process locking member 24 is slipped over a post 68, see FIG. 6 and FIG. 7, with terminal edge 66 facing driveable member 22. Once so positioned terminal edge 66 is positioned into a spacing 70 between post support sleeve 26 and post 68, see FIG. 4, with the outer surface contacting post support sleeve 26. This outer surface form a sleeve contacting surface. As shown in FIG. 3 penetration portion 60 tapers outward while extending inward from terminal edge 66. Following initial insertion of terminal edge 66 into spacing 70 an installation impact force is applied to a striking surface 72 of impact portion 62. This installation impact force may be applied by numerous methods such as by an installation tool 74 shown in FIG. 7 and FIG. 9. Following delivery of such impact force penetration portion 60 of locking member 24 is radially forced between post support sleeve 26 and post 68 positioned therein.

Figure 18:
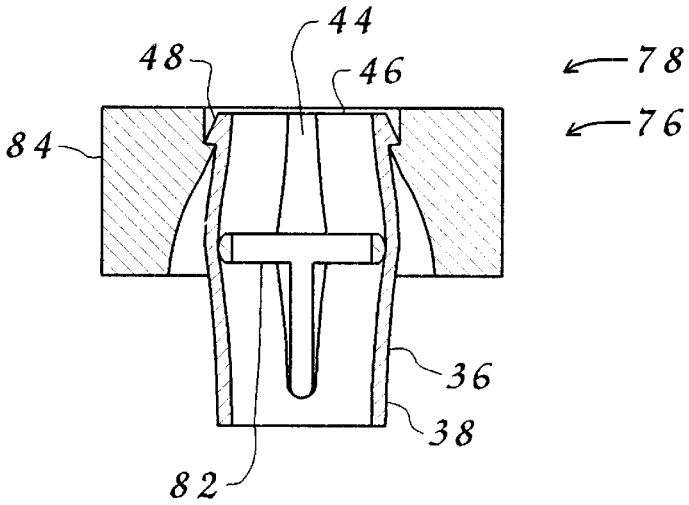
FIG. 18 is an elevational sectional view of the components shown in FIG. 17 following an installation process.

FIG. 14 through FIG. 18 depict a post anchor 76, see FIG. 18, having driveable member 36 and a locking member 78, see FIG. 18. Driveable member 36 has coupling member 48 while locking member 78 has a coupling member 80. Coupling member 48 and coupling member 80 cooperate to retain locking member 78 relative to driveable member 36 following an installation process. Locking member 78 has a first portion 82 and a second portion 84. First portion 82 slides over the post, not shown in these views, during the installation process and is positioned within post support sleeve 38 to flair post support sleeve 38 outward slightly at compression slot 44, see FIG. 17. Second portion 84 then is installed utilizing an impact force to deform post support sleeve 38 back inward above first portion 82 to firmly engage the post positioned within post support sleeve 38. Coupling member 48 then engages coupling member 80 to securely retain locking member 78 relative to driveable member 36.

FIG. 10 through FIG. 13 depict a post anchor 85 having driveable member 54, only the upper most portion of post support sleeve 52 shown, and a locking member 86, see FIG. 13, having a first portion 88 and a second portion 90. During installation first portion 88 is positioned over post 68 and partially positioned into a spacing 92 between post 68 and post support sleeve 52, see FIG. 12. Second portion 90 is positioned over post 68 and forced downward to engage first portion 88. During exertion of further downward pressure first portion 88 is forced into a binding pressure position between post 68 and post support sleeve 52, see FIG. 13, in spacing 92. Coupling member 56 positioned on post support sleeve 52 then engages a coupling member 94 positioned on second portion 90 of locking member 86. This engagement provides for secure retention of locking member 86 relative to driveable member 54.

Installation Procedure

Various procedures, and associated sequences of actions, may be employed to install each combination of a post anchor and a post in the earthen ground. The examples which follow detail several of the many sequences of actions. If it is desired to install the post anchor beneath the surface of the earthen ground a shallow hole is dug. At this point either the post or the driveable member is driven into the earthen ground. If the post has been driven first then it is used as a guide for installation of the driveable member. If the driveable member has been driven first then it is used as a guide for installation of the post. When the driveable member and the post are positioned at the desired depth then the locking member is installed relative to the driveable member.

Various installation tools may be utilized during the installation procedure for post anchors having a driveable member and a locking member. Several of these installation tools may be employed specifically for manipulation of locking members having features of the present invention. Several of these installation tools may be employed for installation of associated driveable members without regard for the type of locking member employed.

One example of an installation tool applicable to driveable members having a post support sleeve extending therethrough for reception of the post involves a pneumatic drive assembly. The pneumatic drive assembly has a shaft suitable for snug insertion into the post support sleeve from the upper extent and of a sufficient length to extend through and beyond the post support sleeve. Utilization of such a pneumatic drive assembly provides for easy installation of the driveable member including a hole beneath the driveable member for subsequent installation of the post. The pneumatic drive assembly ideally would have means to temporarily retain the driveable member on the shaft during alignment and initial penetration of the earthen ground.

Various installation situations may benefit from installation enhancement features. One of these situations involve installation in locales where the ground may freeze. In these locales there may exist a tendency for the post anchor and post to be forced upward depending upon the severity of the environmental extremes. One enhancement involves installation of retention spikes through a portion of the post anchor angularly offset to both horizontal and vertical. This also provides for additional resistance to general movement of the post anchor, and therefore the post, in any environmental situations.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A post anchor comprising:

a) a driveable member comprising:

1) a post support sleeve to provide for reception of a post therein during an installation process, the post support sleeve having:

i) an inner surface;

ii) an outer surface, and;

iii) an upper extent;

2) a plurality of ground engaging fins radially disposed to extend from the outer surface of the post support sleeve;

b) a locking member to provide for a securement of the post within the post support sleeve following the installation process and wherein the locking member contacts the post support sleeve at the inner surface of the post support sleeve following the installation process and contacts an outer surface of the post following the installation process and wherein the locking member applies an expanding force between the post support sleeve and the post following the installation process.

2. A post anchor comprising:

a) a driveable member comprising:

1) a post support sleeve to provide for reception of a post therein during an installation process, the post support sleeve having:

i) an inner surface and;

ii) an outer surface;

2) a plurality of ground engaging fins radially disposed to extend from the outer surface of the post support sleeve;

b) a locking member-to provide for a prolonged application of a binding pressure between the post support sleeve of the driveable member and the post positioned within the post support sleeve of the driveable member during the installation process, the locking member comprising:

1) a penetration portion comprising:

i) an insertion end for insertion into the post support sleeve during the installation process;

ii) an opposing end located distal from the insertion end;

iii) a post contacting surface to contact the post following the installation process, the post contacting surface extending generally from the insertion end to the opposing end;

iv) a sleeve contacting surface to contact the inner surface of the post support sleeve following the installation process, the sleeve contacting surface extending generally from the insertion end to the opposing end;

v) expansion means to provide for an expanding offset between at least a portion of the post contacting surface and a portion of the sleeve contacting surface between the insertion end and the opposing end;

2) a coupling portion to provide for coupling the locking member to the post support sleeve of the driveable member following the installation process.

3. The post anchor defined in claim 2 wherein the driveable member further comprises a sub-grade surface extending outward generally perpendicularly from the post support sleeve, the post support sleeve extending through the sub-grade surface with the upper extent of the post support sleeve partially extending above the sub-grade surface, and wherein each of the ground engaging fins further comprises an upper edge and wherein the upper edge of each ground engaging fin is at least partially secured to a lower surface of the sub-grade surface.

4. The post anchor defined in claim 2 wherein the locking member further comprises an impact portion positioned in close proximity to the opposing end of the penetration portion, the impact portion to provide for reception of an installation impact force during the installation process wherein the penetration portion may be forced between the post support sleeve and the post to apply the binding pressure therebetween.

5. The post anchor defined in claim 2 wherein the coupling portion of the locking member further comprises a radially disposed inner perimeter which radially surrounds an outer extent of the post support sleeve following the installation process.

6. The post anchor defined in claim 2 wherein the coupling portion of the locking member contacts the outer surface of the post support sleeve following the installation process.

7. The post anchor defined in claim 2 wherein the driveable member further comprises an anchor coupling member and wherein the coupling portion of the locking member engages the anchor coupling member during the installation process to secure the locking member relative to the driveable member following the installation process.

8. A post anchor comprising:

a) a driveable member comprising:

1) a post support sleeve to provide for reception of a post therein during an installation process, the post support sleeve having:

i) an inner surface and;

ii) an outer surface;

2) a plurality of ground engaging fins radially disposed to extend from the outer surface of the post support sleeve;

b) a locking member to provide for a prolonged application of a binding pressure between the post support sleeve of the driveable member and the post positioned within the post support sleeve of the driveable member during the installation process, the locking member comprising:

1) an impact portion to provide for reception of an installation impact force during the installation process;

2) a penetration portion to provide for insertion thereof between the inner surface of the post support sleeve and the post in response to the installation impact force to the impact portion during the installation process wherein the penetration portion applies the binding pressure between the post support sleeve of the driveable member and the post positioned within the post support sleeve of the driveable member during the installation process.

9. The post anchor defined in claim 8 wherein the driveable member further comprises a sub-grade surface extending outward generally perpendicularly from the post support sleeve, the post support sleeve extending through the sub-grade surface with the upper extent of the post support sleeve partially extending above the sub-grade surface, and wherein each of the ground engaging fins further comprises an upper edge and wherein the upper edge of each ground engaging fin is at least partially secured to a lower surface of the sub-grade surface.

10. The post anchor defined in claim 8 wherein the locking member further comprises a coupling portion to provide for securing the locking member to the post support sleeve of the driveable member following the installation process.

11. The post anchor defined in claim 8 wherein the driveable member further comprises a coupling member and wherein the locking member further comprises a coupling member and wherein the coupling member of the driveable member and the coupling, member of the locking member engage one another during the installation process to secure the locking member relative to the driveable member following the installation process.

* * * * *